US010257623B2

(12) United States Patent
Lesimple et al.

(10) Patent No.: US 10,257,623 B2
(45) Date of Patent: Apr. 9, 2019

(54) HEARING ASSISTANCE SYSTEM, SYSTEM SIGNAL PROCESSING UNIT AND METHOD FOR GENERATING AN ENHANCED ELECTRIC AUDIO SIGNAL

(71) Applicant: Oticon A/S, Smørum (DK)

(72) Inventors: Christophe Lesimple, Berne (CH); Daniel Bueb, Bern (CH)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 16/026,655

(22) Filed: Jul. 3, 2018

(65) Prior Publication Data

US 2019/0014424 A1 Jan. 10, 2019

(30) Foreign Application Priority Data

Jul. 4, 2017 (EP) ..... 17179472

(51) Int. Cl.
*H04R 25/00* (2006.01)

(52) U.S. Cl.
CPC ..... *H04R 25/552* (2013.01); *H04R 25/405* (2013.01); *H04R 25/407* (2013.01); *H04R 2225/43* (2013.01); *H04R 2225/61* (2013.01)

(58) Field of Classification Search
CPC .. H04R 25/405; H04R 25/505; H04R 25/552; H04R 25/407; H04R 2225/43; H04R 2225/41; G10L 21/028; G10L 17/00
(Continued)

(56) References Cited

U.S. PATENT DOCUMENTS

2014/0010373 A1 1/2014 Gran et al.
2015/0172814 A1 6/2015 Usher et al.
(Continued)

FOREIGN PATENT DOCUMENTS

EP 1 657 958 A1 5/2006
EP 1 720 375 A1 11/2006
(Continued)

*Primary Examiner* — Melur Ramakrishnaiah
(74) *Attorney, Agent, or Firm* — Birch, Stewart Kolasch & Birch LLP

(57) ABSTRACT

The disclosure relates to a hearing assistance system and a system signal processing unit for a hearing assistance system wherein the hearing assistance system comprises at least two binaural hearing systems including a first binaural hearing system and a second binaural hearing system is provided.

The system signal processing unit comprises or is operatively connected to a wireless data communication interface for wirelessly communicating with at least one of said at least two binaural hearing systems. The system signal processing unit is configured to receive a first system electric audio signal and first system spatial information related to said first system electric audio signal originating from said first binaural hearing system, said first system spatial information comprising at least one of a first system angle of incidence of incoming sound and a first system time delay between capturing sound by the two spaced apart hearing devices of said first hearing aid system, and to receive a second system electric audio signal and a second system spatial information related to said second system electric audio signal originating from said second binaural hearing system, said second system spatial information comprising at least one of a second system angle of incidence of incoming sound and a second system time delay between capturing sound by the two spaced apart hearing devices of said second hearing aid system.

The system signal processing unit is further configured to process said first and second system electric audio signals based on said first and second system spatial information and to generate an enhanced electric audio signal.

15 Claims, 9 Drawing Sheets

(58) Field of Classification Search
USPC ..... 381/23.1, 320, 72, 109, 315, 312; 704/226
See application file for complete search history.

(56) References Cited

U.S. PATENT DOCUMENTS

| | | | | |
|---|---|---|---|---|
| 2015/0201287 | A1* | 7/2015 | Jespersgaard ..... | H04R 25/50 381/321 |
| 2017/0105074 | A1* | 4/2017 | Jensen ..... | H04R 25/405 |

FOREIGN PATENT DOCUMENTS

| | | | |
|---|---|---|---|
| EP | 3 007 467 | A1 | 4/2016 |
| EP | 3 157 268 | A1 | 4/2017 |

* cited by examiner c)

b)

a)

HEARING ASSISTANCE SYSTEM, SYSTEM SIGNAL PROCESSING UNIT AND METHOD FOR GENERATING AN ENHANCED ELECTRIC AUDIO SIGNAL

TECHNICAL FIELD

The disclosure refers to a hearing assistance system comprising at least two binaural hearing systems, each binaural hearing system comprising two hearing devices such as hearing aids. The disclosure further refers to a system signal processing unit for such hearing assistance system and to method for generating an enhanced electric audio signal.

BACKGROUND

Hearing is a critical aspect of communication. It's crucial to developing meaningful relationships and fully enjoying life. Better hearing enables people to connect to those around them and participate in community life in any situation. Binaural hearing devices can assist a user in perceiving and understanding acoustic messages. A Binaural hearing system comprises typically two hearing devices, one hearing device for each ear of the user.

Thus, a binaural hearing system is able to convey spatial information to a hearing aid user, in particular information about an angle of incidence of sound with respect to the binaural hearing system. The binaural hearing system help restore binaural hearing characteristics in order to let the hearing user to benefit from perceptual spatial information Two hearing devices forming a binaural hearing system are typically arranged at or close to the user's ears. Accordingly, the two hearing devices of a binaural hearing system are spaced apart from one another along an axis that is orientated perpendicular to a user's line of sight when looking straight ahead.

The angle of incidence of an incoming sound is helpful to discriminate acoustic messages from different sound sources from one another.

It is well known, that a hearing device such as a hearing aid comprises or is connected to a microphone for capturing sound and providing an electric input sound signal. The electric input sound signal is fed to a processing unit, for instance a digital signal processor that processes the electric input sound signal in order to generate an electric output sound signal. The electric output sound signal can then be fed to a transducer and other means that convert the electric output sound signal into a user perceived output signal. The output transducer can for example be a speaker or receiver that converts the electric output sound signal into sound that can be perceived by a user. Alternatively, the electric output sound signal can be converted into electric stimuli that can be fed to an electrode array for stimulating for instance a cochlear.

Being in the audience (theatre, conferences, concerts, trainings, educations, speeches in a church . . . ) is a major problem for many hearing aid users even with advanced signal processing algorithm. Accordingly, there are situations, where the user of a binaural hearing system still may have difficulties to understand acoustic messages. If a user, for instance, is sitting on a back bench in a classroom, it may still be difficult for the user to listen and/or understand to the teacher or professor.

For such situations, it is possible to provide the professor or teacher with a remote microphone device that can pick up the speaker's voice and wirelessly transmit an electric signal representing the speaker's voice to the binaural hearing system of the user. This, however, requires that the speaker is equipped with such remote microphone system and the remote microphone system is compatible with the user's hearing system. The remote microphone system has no dependency to monaural or binaural hearing system.

In general, assistive listening devices (ALD) like remote microphone, induction loop, or FM systems are designed to enhance the ratio between useful and detrimental (noise and reverberation) signals. These systems require extra equipment and specific installation:

- Each speaker has a microphone,
- The room is equipped with an usable induction loop or FM system,
- The hearing aid user knows how and when to benefit from the installation.

All these requirements drastically restrict the situations where hearing aid users can use available technique to improve their listening experiences.

SUMMARY

It is an object of the disclosure to provide an alternative hearing assistance system that can assist an individual binaural hearing system as part of the hearing assistance system.

To meet this object, a system signal processing unit for a hearing assistance system that comprises at least two binaural hearing systems including a first binaural hearing system and a second binaural hearing system is provided.

Each binaural hearing system comprises two spaced apart hearing devices. Each hearing device comprises at least one input transducer for capturing incoming sound, input transducers of the two spaced apart hearing devices defining a reference axis. Each binaural hearing system is configured to determine a system angle of incidence of incoming sound with respect to said reference axis and/or a system time delay between capturing of sound by the two input transducers of the two hearing devices of the respective binaural hearing system.

The system angle of incidence of incoming sound is used as a measure for the direction to a sound source that is not as such part of the system, e.g. the system could be comprised of two sets of binaural hearing aids mounted or worn by two persons, and the two binaural hearing aid systems then cooperate to determine the direction and/or distance to a remote source, e.g. a third person talking. This is contemplated to allow at least two hearing aid systems worn by at least two individuals to cooperate to provide enhanced audio to at least one of the two individuals using one of the hearing aid systems. Further, when two such hearing aid systems are in communication, both hearing aid systems may benefit from the combined system in establishing enhanced audio for both individuals. Even further, more than two hearing aid systems may communicate to establish enhanced audio. Not all hearing aid systems in the combined system needs to have identical specification, e.g. one user may use a binaural hearing aid whereas another may have a different configuration. Also, hearing aid types of the individual hearing aid system may be different, e.g. one user may have a behind-the-ear hearing aid at one ear and another type at the opposite ear.

The system signal processing unit comprises or is operatively connected to a wireless data communication interface for wirelessly communicating with at least one of said at least two binaural hearing systems. The system signal processing unit is configured to receive;

a first system electric audio signal and first system spatial information related to said first system electric audio signal originating from said first binaural hearing system, said first system spatial information comprising at least one of a first system angle of incidence of incoming sound and a first system time delay between capturing sound by the two spaced apart hearing devices of said first hearing aid system and a second system electric audio signal and a second system spatial information related to said second system electric audio signal originating from said second binaural hearing system, said second system spatial information comprising at least one of a second system angle of incidence of incoming sound and a second system time delay between capturing sound by the two spaced apart hearing devices of said second hearing aid system.

It is also possible to have a system signal processing with more than two system electric audio signals.

The system signal processing unit further is configured to process said first and second system electric audio signals based on said first and second system spatial information and to generate an enhanced electric audio signal.

Such system processing unit can make use of any of the input signals provided by any of the input transducers of any of the binaural hearing systems for providing the enhanced electric audio signal the binaural hearing systems. In a way, any input transducer may act as a remote microphone for the binaural hearing systems of the hearing assistance system while additionally being able to take the individual angles of incidence into account.

The system signal processing unit can be implemented in a smart hearing aid or a smartphone or any other portable or even stationary device providing sufficient processing power.

The disclosure includes recognizing that technology with higher processing power and communication possibilities like smartphones becomes more popular.

Preferably, the first and the second hearing aid systems both may be configured to discriminate at least two audio sources by assigning, based on the system time delay between capturing of sound and/or the system angle of incidence of incoming sound, incoming sound to one audio source of a group of sound sources comprising at least a first audio source and a second audio source.

The system signal processing unit may be further configured to determine for the first binaural hearing system a first system first source distance between a first audio source and the first binaural hearing system by using trigonometry based on the first and second system spatial information and the first and second system time delay data and to determine for the second binaural hearing system a second system first source distance between a first audio source and the second binaural hearing system by using trigonometry based on the first and second system spatial information and the first and second system time delay data.

The system signal processing unit may further be configured to determine a target audio source among the at least two audio sources. This can be achieved by determining the target audio source as being the source that is assigned to the strongest consistent system electric audio signal over time. Additionally or alternatively, the target sound source can be determined as being the source that is assigned to the system electric audio signal providing a minimum mean square error (MMSE) on the angles (i.e. the first and second angles) from the binaural hearing systems.

This thus allows for automatic determination of a target sound source.

In one variant, the system signal processing unit is configured to determine the strongest consistent system electric audio signal over time by calculating;

$$\text{ArgMax}\ (\text{Sum}\{\text{for each } S(k)\}\ \text{Sum}\{\text{for each received audio signal, } R(i)\}),$$

where Sk is an audio source.

Alternatively or additionally, the system signal processing unit may be configured to determine the system electric audio signal providing a minimum mean square error (MMSE) over the angles of incidence received from the binaural hearing systems by calculating;

$$\text{ArgMax sum}(\text{angle}(i)\hat{}2).$$

It is preferred if the system signal processing unit is configured to generate the enhanced electric audio signal based on the system electric audio signal corresponding to and/or originating from the determined target audio source.

The object of the disclosure is further achieved by a hearing assistance system that comprises a signal processing unit as set out above, and at least two binaural hearing systems, wherein each binaural hearing system comprises first and second hearing devices. Each of the hearing devices comprises an input transducer configured to receive an acoustic sound signal and to convert said acoustic sound signal into a device electric input audio signal, and an output transducer that is configured to convert a hearing device electric audio output signal into an audio output signal that a user can perceive as sound. The input transducers of the two hearing devices of a respective binaural hearing aid system define a reference axis that typically is oriented perpendicular to a sagittal plane of a user's head.

Advantageously, each binaural hearing system may comprise;

at least one wireless interface unit configured to communicate with the system signal processing unit and receiving generate an enhanced electric audio signal from the system signal processing unit, and at least one hearing aid signal processing unit being operatively connected to said input transducer, said output transducer and said wireless interface and being configured to process said device electric input audio signal and said enhanced electric audio signal (received from the system signal processing unit) to generate hearing device electric output audio signals for each output transducer.

The hearing aid signal processing unit may be configured to process the device electric input audio signals from first and second hearing devices, and to determine a first angle of incidence between an audio source and the axis of reference defined by the respective binaural hearing system, wherein the angle of incidence is determined based on a time delay between the two device electric input audio signals at the first and the second hearing device of the binaural hearing system, to thus generate said spatial information.

The system signal processing unit may implemented in a server or: in a separate portable device, in particular in a personal multi-purpose portable device such as a smartphone.

According to a further aspect of the disclosure, a method for generating an enhanced electric audio signal is provided. The method comprises the steps:

receiving a first system electric audio signal and first system spatial information related to said first system electric audio signal originating from said first binaural hearing system, said first system spatial information comprising at least one of a first system angle of incidence of incoming sound and a first system time delay between capturing sound by the two spaced apart hearing devices of said first hearing aid system, receiving a second system electric audio signal and second system spatial information related to said second system electric audio signal originating from said second binaural hearing system, said second system spatial information comprising at least one of a second system angle of incidence of incoming sound and a second system time delay between capturing sound by the two spaced apart hearing devices of said second hearing aid system, processing said first and second system electric audio signals based on said first and second system spatial information, and generating an enhanced electric audio signal from said first and second system electric audio signals.

Receiving the first and second system electric audio signals and first and second system spatial information should occur mere or nearly at the same time or simultaneously to coincidently in order to maintain the temporal coherence of the signals and information.

The method may further comprise discriminating at least two audio sources by assigning, based on the time delay between capturing of sound and/or the angle of incidence of incoming sound, incoming sound to one audio source of a group of sound sources comprising at least a first audio source and a second audio source.

The present disclosure also relate to a method for operating a hearing aid and/or a method for operating a binaural hearing aid system and/or a method for operating a system comprising two hearing aid systems and/or a method for operating a system comprising two hearing aid systems and an external device. Each of the methods may comprise steps of the other methods mentioned herein, e.g. steps for generating an enhanced electric audio signal including any needed steps for operating a hearing aid or binaural hearing aid system for obtaining such an enhanced electric audio signal.

The method may further comprise determining for the first binaural hearing system a first system first source distance between a first audio source and the first binaural hearing system by using trigonometry based on the first and second system spatial information and the first and second system time delay data and determining for the second binaural hearing system a second system first source distance between a first audio source and the second binaural hear-ing system by using trigonometry based on the first and second system spatial information and the first and second system time delay data.

According to a further aspect, a data storage device containing data representing software code that when run on a personal mobile device performs the method as set out above.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

Figure 1:
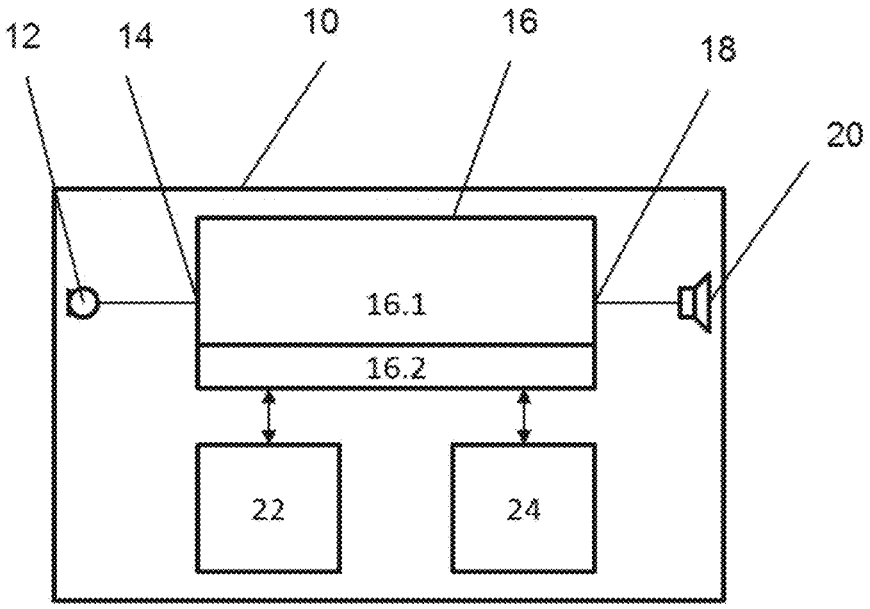
FIG. 1: is a schematic representation of a hearing device.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be worn in any known way. This may include i) arranging a unit of the hearing device behind the ear with a tube leading air-borne acoustic signals or with a receiver/loudspeaker arranged close to or in the ear canal such as in a Behind-the-Ear type hearing aid or a Receiver-in-the Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant, or iv) arranging a unit of the hearing device as an entirely or partly implanted unit such as in Bone Anchored Hearing Aid or Cochlear Implant.

A hearing device may be part of a "hearing system", which refers to a system comprising one or two hearing devices, disclosed in present description, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefitting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follows.

As can be taken from FIG. 1, the hearing device 10 comprises a microphone 12 that is electrically connected to a signal input 14 of a processing unit 16. Microphone 12 provides an electric input sound signal to processing unit 16. The electric input sound signal represents sound captured or picked up by microphone 12.

Processing unit 16 is configured to process the electric input sound signal in order to generate an electric output sound signal that is provided at a signal output 18 of processing unit 16. Signal output 18 is operatively connected to an output transducer 20. The output transducer can be a speaker or receiver that converts the electric output sound signal into acoustic sound that can be perceived by a user or floating mass for bone anchored or middle ear implant.

Alternatively, the output transducer can be an electrode array of a cochlear implant for delivering stimulation pulses to the cochlea.

Likewise, signal input 14 of processing unit 16 can be operatively connected to other sources of electric input sound signals such as telecoiles, Bluetooth receivers, Wi-Fi receivers or the like.

Hearing aid 10 further comprises a data interface 24 for receiving data and an electric sound signal from another hearing aid, for instance another hearing aid of the some binaural hearing system. Data interface 24 can be a wireless transceiver or receiver for wireless data communication with an external transmitter or transceiver.

Processing unit 16 is configured to process electric input sound signals according to operation program code and/or operation parameter values stored in a memory unit 22.

In particular, processing unit 16 is configured to generate a first system electric audio signal and first system spatial information from the electric input sound signal and an electric sound signal from another hearing aid of the some binaural hearing system.

Figure 2:
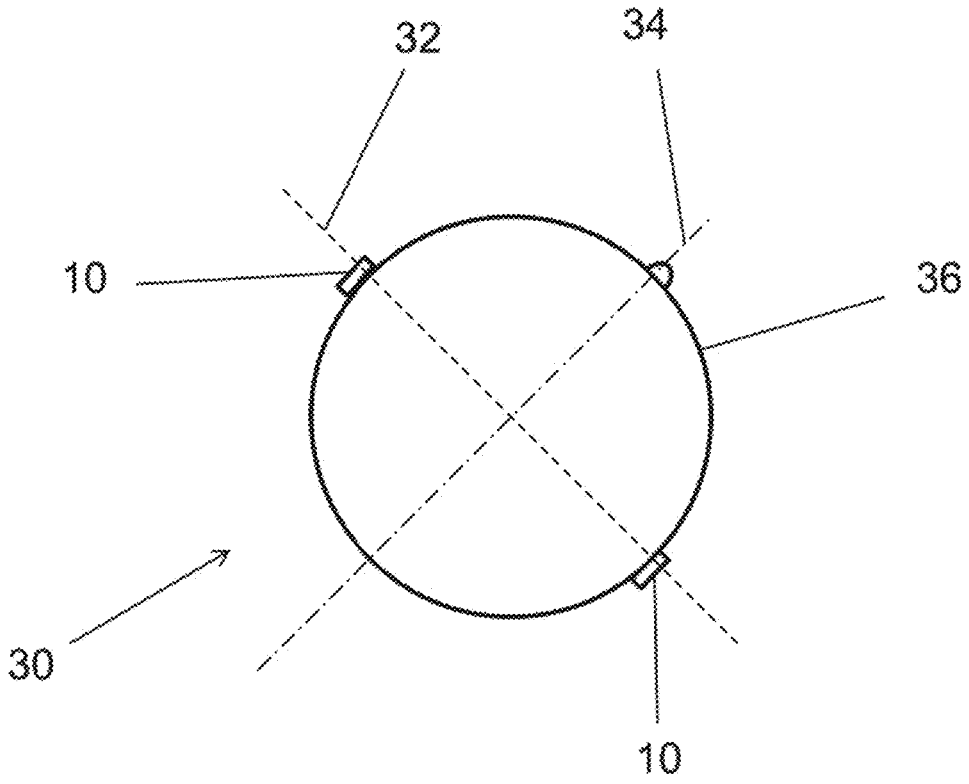
FIG. 2: is sketch illustrating geometric relation of two hearing devices forming a binaural hearing system.

FIG. 2 illustrates a binaural hearing system 30 comprising two hearing aids 10, each hearing aid 10 being arranged at or near a users right and left, respectively, ear. The two hearing devices 10 of the binaural hearing aid system 30 define a reference axis 32 that typically is oriented perpendicular to a sagittal plane 34 of a user's head 36.

Figure 3:
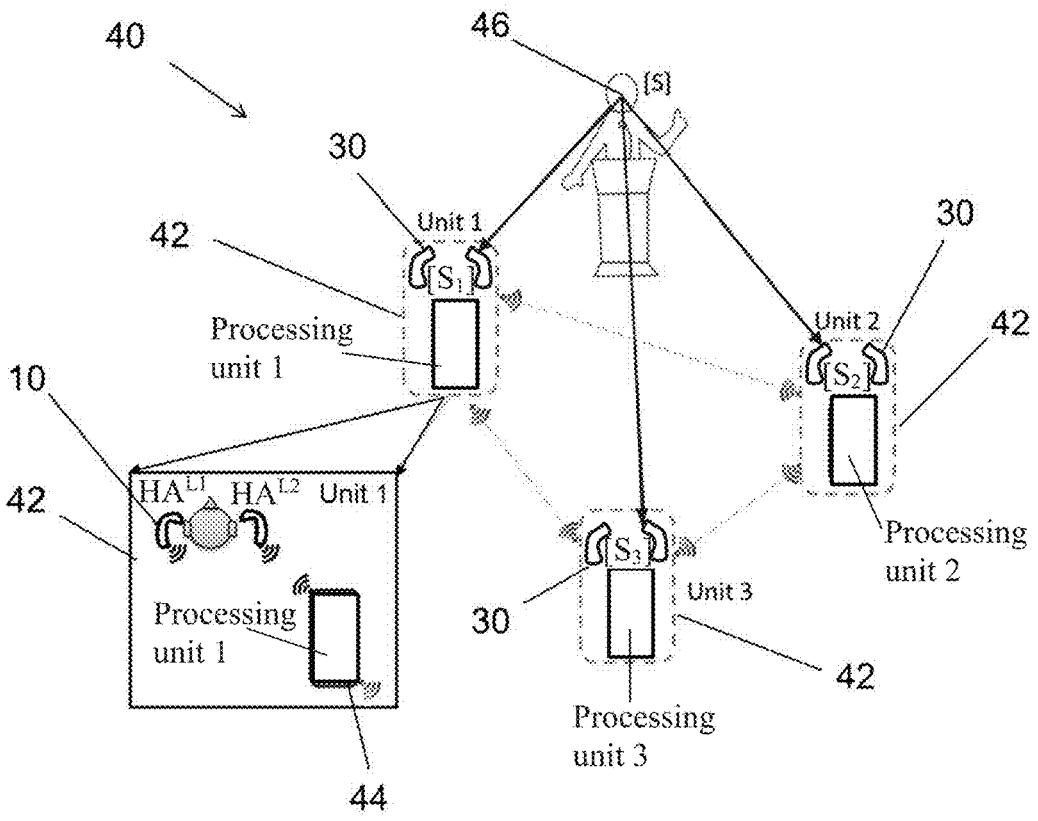
FIG. 3: illustrates a hearing assistance system comprised of a plurality of hearing devices.

FIG. 3 illustrates a hearing assistance system 40 that is comprised of a plurality of hearing devices 42, each hearing device comprising a hearing device 10 or a binaural hearing system 30 and potentially a processing unit 44. The processing unit 44 of a hearing device 42 can be a separate device such as a smartphone or can be integrated in a hearing device 10.

The purpose of the hearing assistance system 40 of FIG. 3 is to provide an enhanced presentation of sound from sound source 46 for all hearing devices 42 of hearing assistance system 40.

Each hearing device 42 comprises means for determining at least the relative location of the hearing device with respect to other hearing devices of the hearing assistance system 40. Relative location can be determined based on GPS, WIFI, wireless signal, such as WLAN or another wireless protocol, Bluetooth, sound-hash, detected devices nearby or the like.

As pointed out above, the processing unit of a hearing device 42 can be implemented by way of a smartphone or a similar mobile device 44 of a user of a hearing device or a binaural hearing system, wherein the user's mobile device (for instance, the smartphone) runs dedicated application software, hereinafter called "app". The app is configured to cause the respective mobile devices 44 of the hearing assistance system 40 to establish automatically a peer-to-peer wireless network for low latency interaction and transmission between the hearing devices 42 of the hearing assistance system 40.

The app is configured to cause the respective mobile devices 44 of the hearing assistance system 40 to contribute to processing system electric audio signals based on system spatial information and to generating an enhanced electric audio signal.

For this purpose, the hearing devices 42 of the hearing assistance system 40 form a microphone array that includes microphone of the hearing devices 10 in the respective hearing devices 42. The electric sound signals thus captured are shared between the hearing devices 42.

Figure 4:
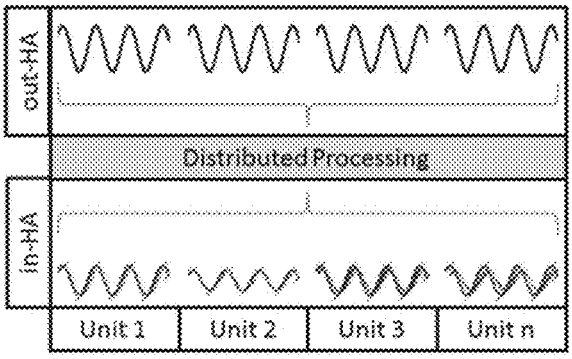
FIG. 4: illustrates that sound improving calculations may be distributed.

FIG. 4 illustrates that sound improving calculations for generating an enhanced electric audio signal may be distributed over the processing units of the hearing assistance system. Processing may be split upon task (like: beamforming, reverberation suppression, noise reduction, sound source focus with ITD & ILD . . . ) and/or on frequency partitioning dynamically; but probably not on time frames due to latency requirements. Distributing processing improves the overall calculation power at a lower energy consummation at an individual processing unit. Low latency is crucial for these real time calculations because for instance reflections later than 20 ms can cause timbral colorization.

Figure 5:
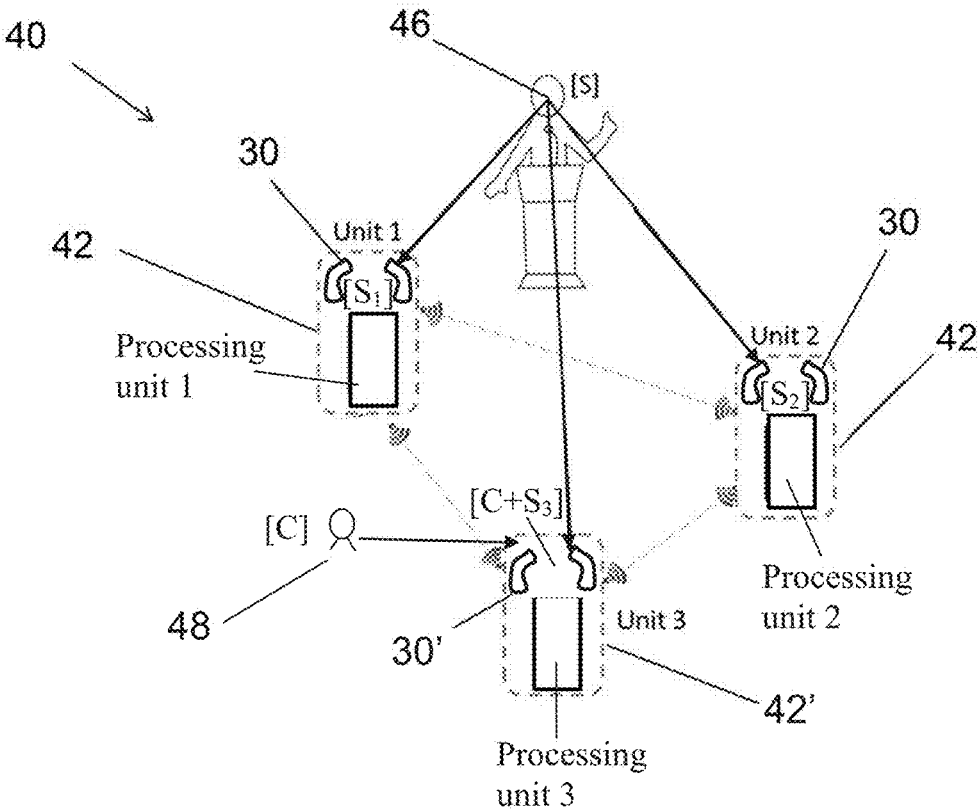
FIG. 5: illustrates that an individual hearing devices may receive a different signal than the other hearing devices of the hearing assistance system.

In the example, the hearing devices 42 of hearings assistance system 40 are interested in focus on the same sound source 46 of interest. All hearing devices 42 are interested in the same resulting, improved output sound signal representing an enhanced acoustic message. However, as illustrated in FIG. 5, a dedicated hearing devices 42' might focus on another sound source 48.

It is noted that the hearing assistance system 40 is not dependent on a local available infrastructure (ALD, network) at all.

It is further noted that some non-time critical managements and data analysis can be done in a protected cloud solution. If network latency would be decreased in the next years, also the processing unit 44 could be extended to the cloud. Thus it might also be enhanced with elaborated machine learning approaches (e.g. as like the "deep learning machine" solves the "Cocktail Party Problem".)

Figure 6:
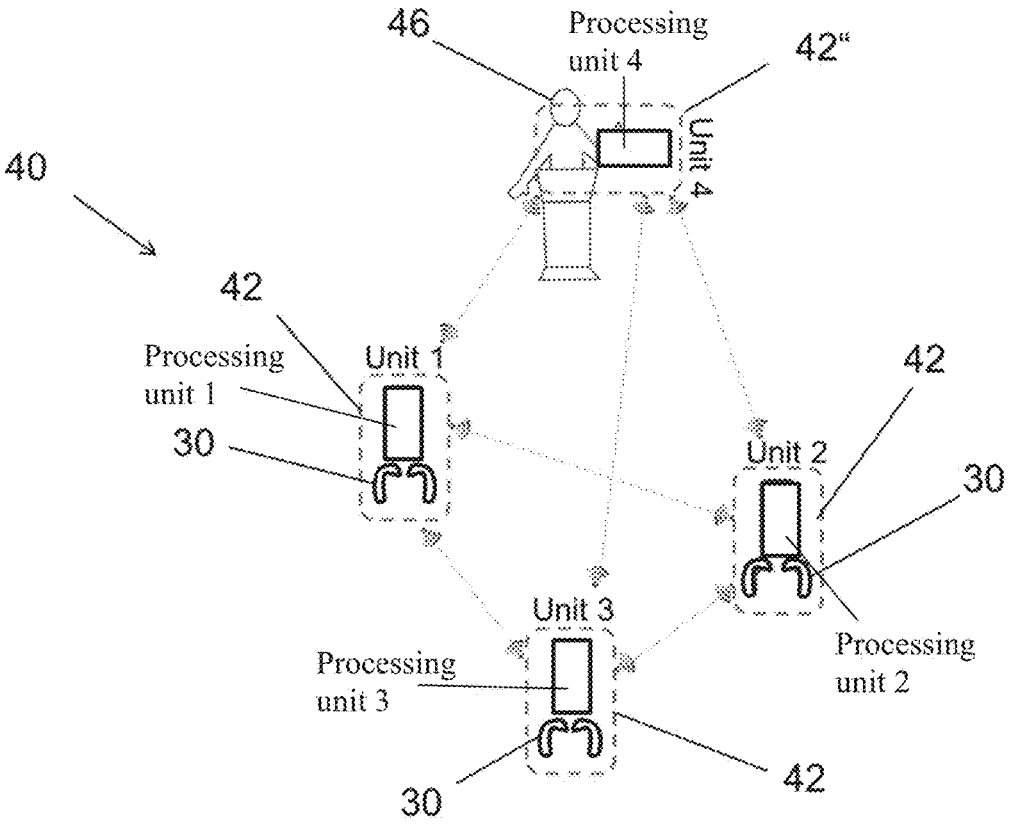
FIG. 6: illustrates that one hearing device may for instance only comprise a microphone and a processing, but no hearing device.

In a further variant as illustrated in FIG. 6, a hearing device 42" might consist of a processing unit 44 and an audio input source, for instance a microphone or a transmitter of audiovisual equipment. The system in FIG. 6 is in some respect similar to assisted listening devices but it provides a still enhanced output sound signal for each hearing device 42 because calculating from the enhanced electric audio signal an individual enhanced electric output sound signal for each hearing device 10 takes into account the relative spatial position and orientation of the individual hearing device 42.

Figure 7:
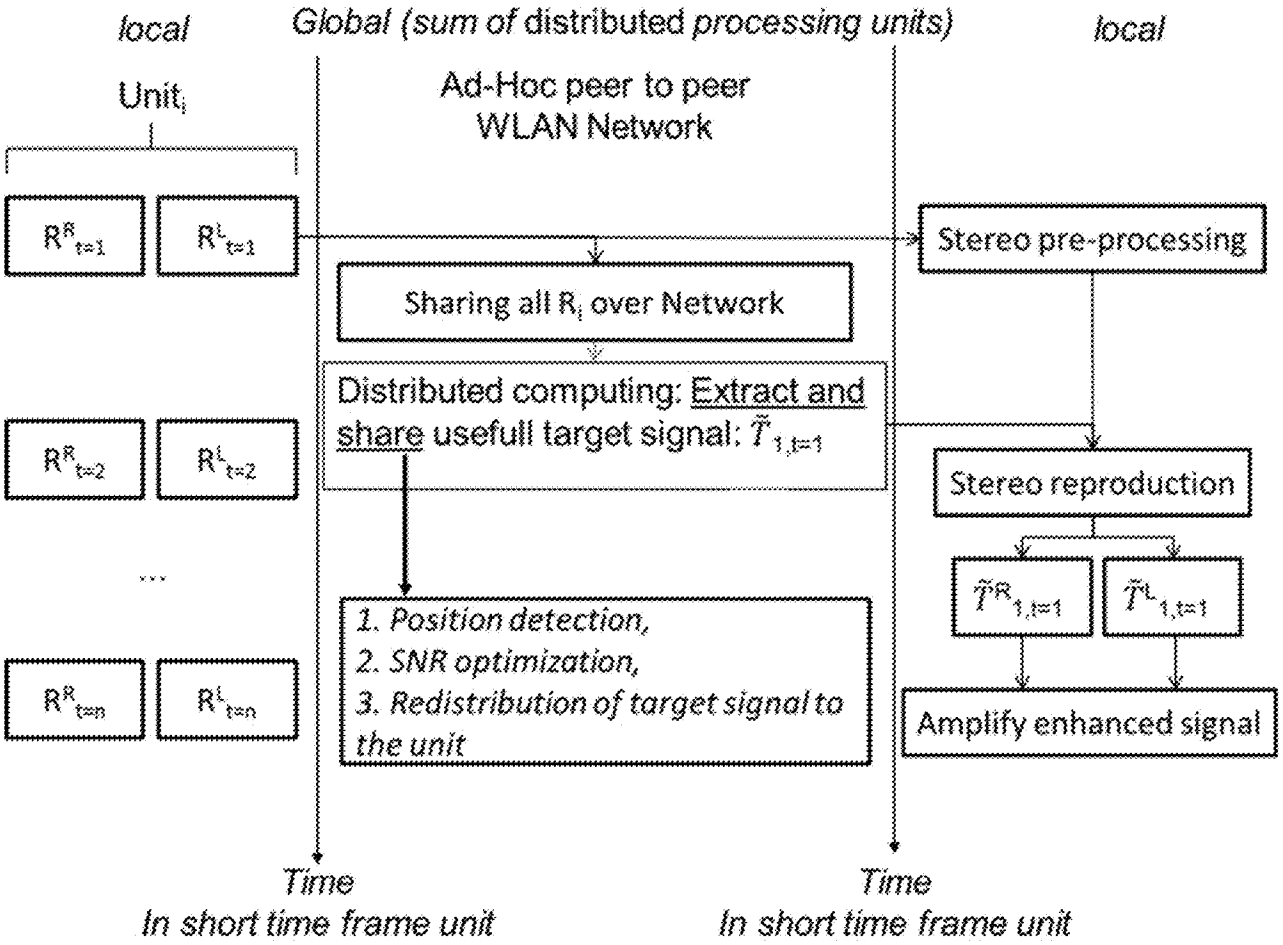
FIG. 7: illustrates processing of a plurality of system electric audio signals and system spatial information in order to generate an enhanced electric audio signal.

FIG. 7 illustrates processing of a plurality of system electric audio signals and system spatial information provided by individual hearing devices 42 in order to generate an enhanced electric audio signal. In FIG. 7, the system electric audio signals and the system spatial information are marked with R ($R^R$: right ear hearing device; $R^L$: left ear hearing device) and are hereinafter called "received signals".

All received signals are shared over the network that is formed by the hearing devices 42 of the hearing assistance system 40.

By way of distributed computing, a useful target signal $\tilde{T}_{1,j=1}$ is determined. This involves position detection and signal-to-noise-ratio optimization. The target signal is redistributed to the hearing devices 42.

Each individual hearing device 42 performs an individual stereo preprocessing and—after receiving the redistributed target signal—a stereo reproduction that takes into account the position and orientation of the individual hearing device 42 relative to the target sound source 46.

Figure 8:
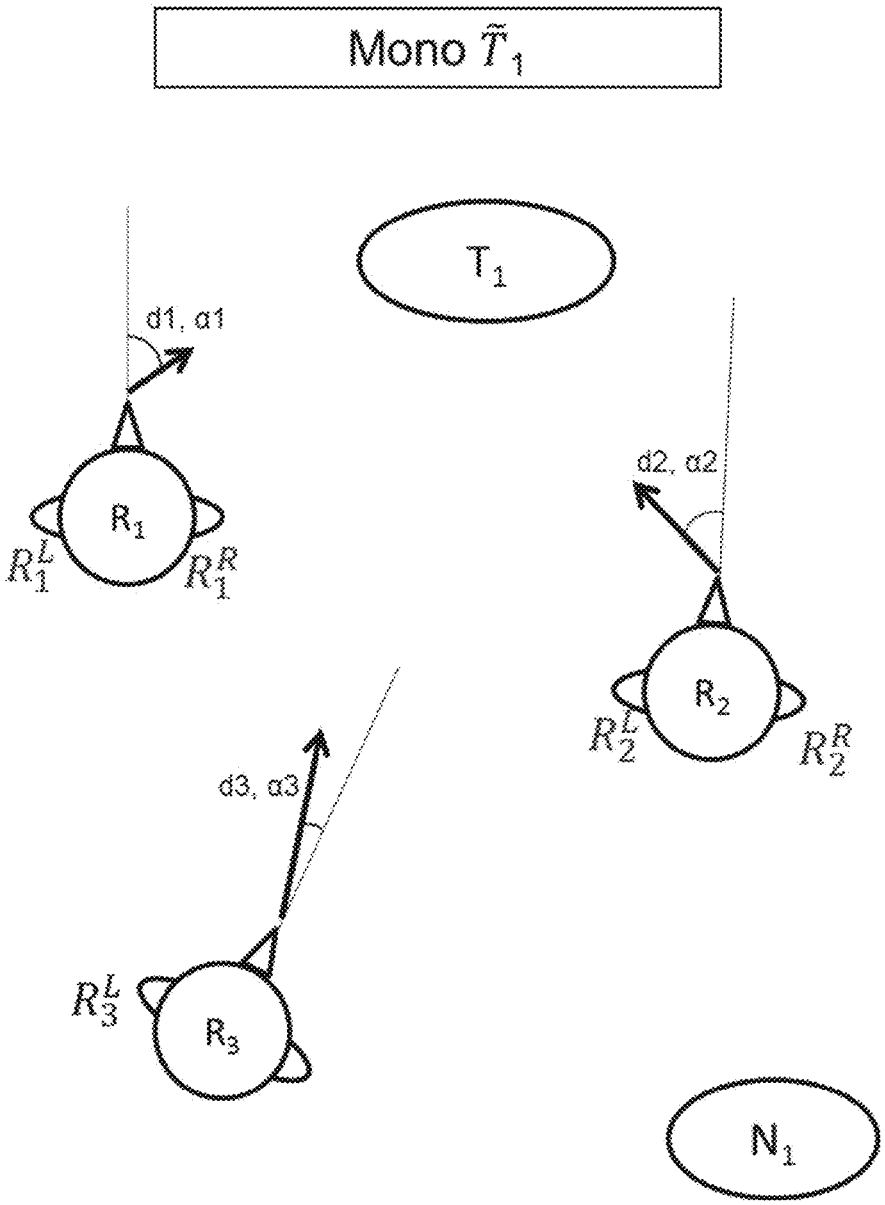
FIG. 8: illustrates position detection for each individual hearing device.

FIG. 8 illustrates position detection for each individual hearing device 42 that is the detection of the distance from and the orientation relative to the target sound source 46 in order to achieve a perceptual correct reproduction as pointed out above.

Position detection includes finding a correlation signal between the received signals R and estimating orientation angle a individually based on the individual interaural time differences Δt:

$$\alpha_{i_k} = \sin^{-1}\left(\frac{\Delta t_{i_k} \times c_s}{\tau}\right)$$

wherein τ is the distance between the ears of a user and estimated to be 21 cm. $c_s$ is the speed of sound, e.g. 343 m/s.

Further, the distances d are calculated for instance using trigonometry. If all angles a ad all interaural time differences Δt are determined, the distances can be calculated. Having all $\alpha_{i_k}$ and $\Delta t_{i_k}$ one can derive the missing distances using trigonomentry. Sample quadrangle with $R_1$, $R_2$, $T_1$, $N_1$: {given: α,β,γ,δ,a',b'}, {find a, b} with $\alpha=|\alpha_{1_1}-\alpha_{1_2}|$, $\beta=|\alpha_{2_3}-\alpha_{2_4}|$, $\gamma=360-\alpha_{1_1}+\alpha_{2_3}$ and $\delta=360-\alpha_{1_2}+\alpha_{2_4}$.

The result of the position detection is put out by an individual hearing device 42 as a vector space with tuplets (distance d and angle α) providing the distance and angle with respect to a target sound source $T_1$ and noise sound sources $N_1$ to $N_t$. The output may alternatively or additionally comprises an estimation of the amplitude attenuation and time delay for each individual hearing device with respect to the target sound source $T_1$ and noise sound sources $N_1$ to $N_i$. The number of noise sources that can be calculated is limited by the number of hearing devices 42 in the hearing assistance system 40. Weak noise sources can be processed as random noise.

From this information, an enhanced electric audio signal can be generated. This can be done by the system signal processing unit that is configured to generate the enhanced electric audio signal based on the system electric audio signal corresponding to the deter-mined target audio source.

In a scenario with one target sound source $T_1$ and one noise sound source $N_1$ and two hearing devices 42 whose microphones provide electric audio signals $R_1$ and $R_2$ the following calculations may apply:

$$R_1 = (A_{R1,T1})T_1 + (A_{R1,T1})N_1 + RandomNoise(R_1)$$

$$R_2 = (A_{R2,T1})T_1 + (A_{R2,T1})N_1 + RandomNoise(R_2)$$

$$A_{R1,N1}((A_{R2,T1})T_1 + \text{Random Noise}(R_2) - R_2) = A_{R2,N1}((A_{R1,T1})T_1 + RandomNoise(R_1) - R_1),$$

$$A_{R1,N1}((A_{R2,T1})T_1 - A_{R2,N1}((A_{R1,T1})T_1 = A_{R2,N1}(RandomNoise(R_1) - R_1)) + A_{R1,N1}(RandomNoise(R_2) - R_2)),$$

$$T_1 = \frac{R_{R2,N1}(RandomNoise(R_1) - R_1) - A_{R1,N1}(RandomNoise(R_2) - R_2)}{A_{R1,N1}A_{R2,T1} - A_{R1,N1}A_{R2,T1}},$$

$$\text{with } \lim_{n \to \infty} \frac{1}{n}\sum \frac{n}{1} RandomNoise(R_1) = 0,$$

$$\text{assuming } \sum \frac{n}{i=1} \text{abs}(RandomNoise(R_1)) < \sum \frac{n}{i=1} \text{abs}(A_{Ri,T1})$$

$$\text{knowing } \frac{A_{R2,N1}RandomNoise(R_1) - A_{R1,N1}RandomNoise(R_2)}{A_{R1,N1}A_{R2,T1} - A_{R2,N1}A_{R1,T1}}.$$

The example with two hearing devices can be expanded with more R and N. Please be aware that due to mathematical restriction maximal (n-1) N's can be eliminated having n R's.

In order to apply the sample formulas above, it is assumed that the electric audio signals are synchronized in terms of time to simply example formula.

If the distance between a hearing device 42 and a target source 46 is too big, than the electric audio signal $R_i$ provided by the hearing device 42 will not be considered for calculating the target electric audio signal $T_1$ due to latency, but might be used for detrimental noise classification.

Accordingly, a target electric audio signal $\tilde{T}_1$ with eliminated localized detrimental noise and reduced average random noise—compared to the hearing device's electric audio signal R—can be calculated:

$$\tilde{T}_1 = \frac{A_{R1,N1}R_2 - A_{R2,N1}R_1}{A_{R1,N1}A_{R2,T1} - A_{R2,N1}A_{R1,T1}}$$

The target electric audio signal $\tilde{T}_1$ thus calculated can be used by each individual hearing device 42 to reproduce a local stereo signal for the user. For reproducing the target audio signal, from the target electric audio signal $\tilde{T}_1$ an individual interaural time difference and an interaural level difference is estimated. The individual distance d between the hearing device 42 and the target sound source 46 and the orientation angle a are used for stereo reproduction with side dependent weights on delay Δt and amplitude attenuation A to correct the incoming target electric audio signal for the individual hearing device 42.

The delay is calculated as follows:

$$delay_i^L = \frac{distance_R + \sin \alpha_i * \tau}{c_s}[s]$$

$$delay_i^R = \frac{distance_R + \sin \alpha_i * \tau}{c_s}[s]$$

The level (amplitude attenuation) is calculated as follows:

If the level at the nearest person (hearing device 42) with $distance_{near}$ to the target sound source 46 emanating target audio signal $T_1$ is $L_{near}$, then the level $\tilde{L}_i$ at another person (hearing device 42) equals to $\tilde{L}_i = L_{near} - |10*\log(distance_{near}/distance_i)^2|$ At both ears:

$$\tilde{L}_i = \frac{L_i^R + L_i^L}{2}$$

$$L_i^R = L_i^L - \left|10 * \log\left(\frac{r_i^L}{r_i^R}\right)^2\right|$$

$$\Delta L = \left|10 * \log\left(\frac{r_i^L}{r_i^R}\right)^2\right|$$

$$L_i^R = \tilde{L}_i - \left|10 * \log\left(\frac{\text{distance}_i}{\text{distance}_i + \sin \alpha_i * \tau}\right)^2\right|$$

$$L_i^L = \tilde{L}_i - \left|10 * \log\left(\frac{\text{distance}_i}{\text{distance}_i + \sin \alpha_i * \tau}\right)^2\right|$$

Figure 9:
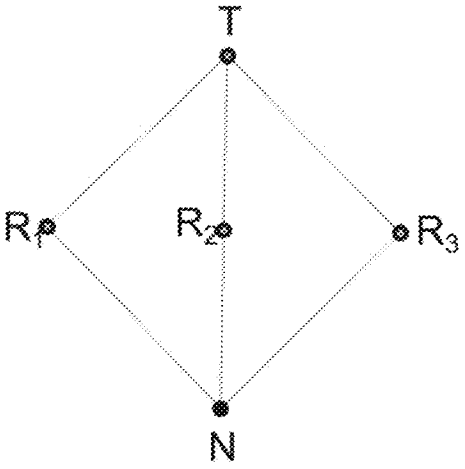
FIG. 9*a*), *b*) and *c*): illustrate certain configurations that affect unambiguous determination of the relative position of the hearing devices relative to a sound source.
Figure 9:
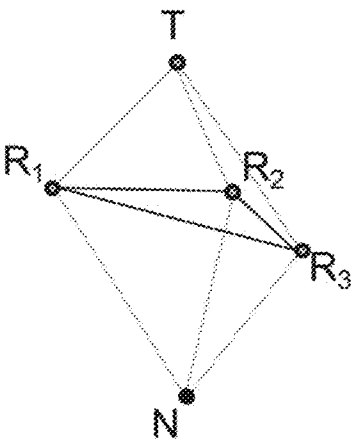
Figure 9:
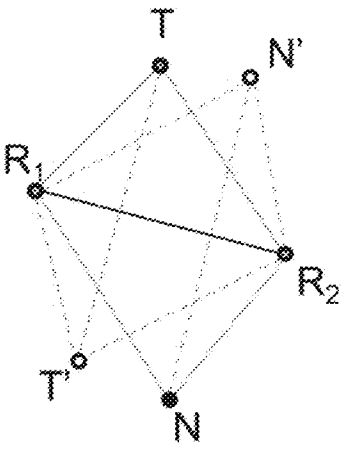

FIG. 9*a*), *b*) and *c*) illustrate certain configurations that affect unambiguous determination of the relative position of the hearing devices relative to a target sound source T or a noise sound source N.

As shown in FIG. 9*a*), with only two hearing devices, "phantom" sound source locations are created when processing the received signals $R_1$ and $R_2$.

With at least three hearing devices with one microphone each unambiguous determination of the sound source positions should be possible in general when using basic trigonometry; cf FIG. 9*b*). In perfect symmetry in the free field—as sketched in FIG. 9*c*)—more information would be needed to determine if the sound if from front or from back.

Figure 10:
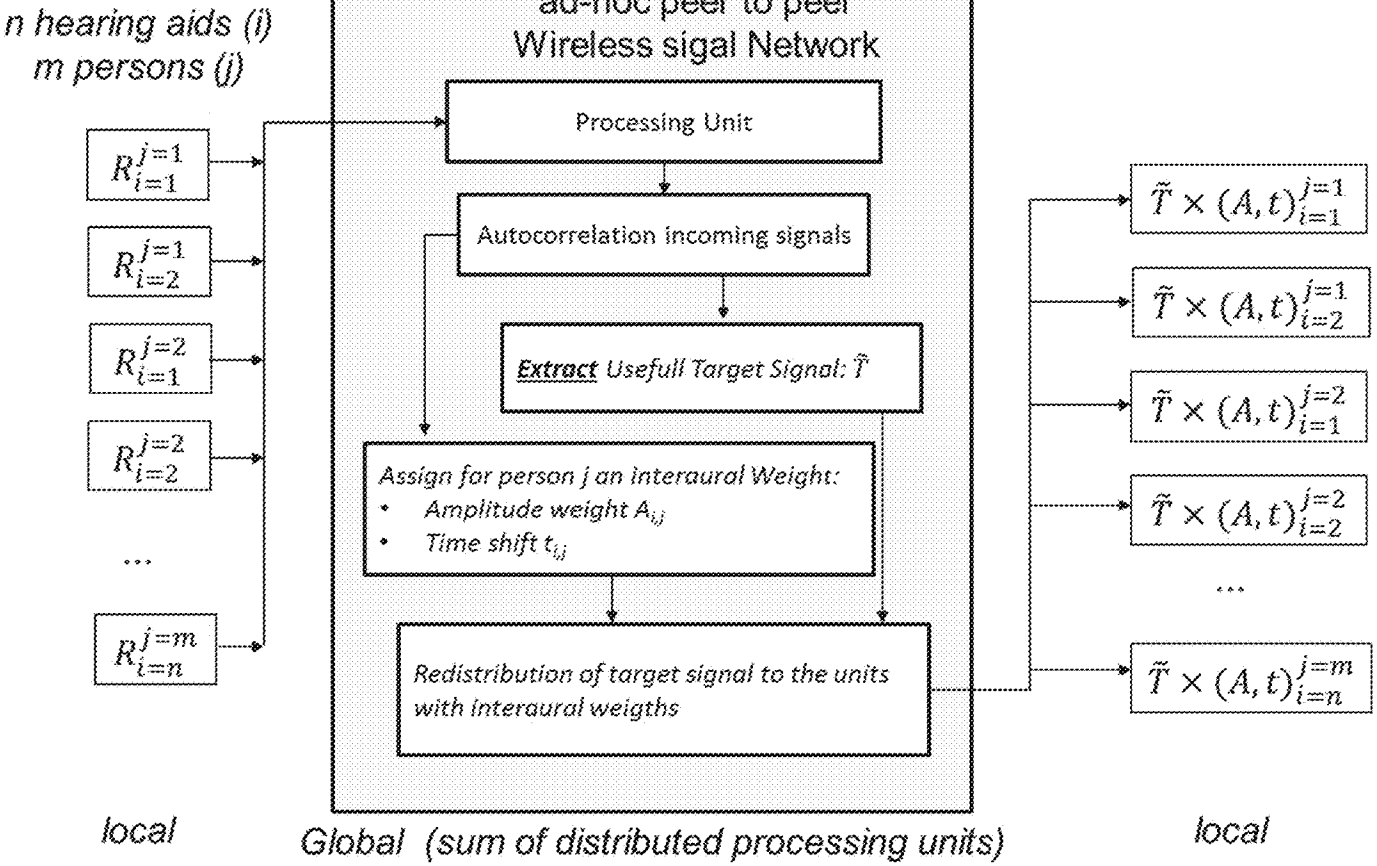
FIG. 10: illustrates processing of a plurality of system electric audio signals and system spatial information in a scenario with a plurality of sound sources.

FIG. 10 illustrates processing of a plurality of system electric audio signals and system spatial information provided by individual hearing devices 42 in a scenario with a plurality of sound sources, for instance multiple speakers.

The solution disclosed with respect to FIGS. 7 and 8 is dedicated for situations with a single source like in a classroom, a small conference or the like.

In other situations, the signal of interest (target signal) T is reproduced by a multiple loudspeakers setup like in a church, in a movie theater, in big conference room or the like; cf FIG. 10.

The solution displayed in FIG. 10 uses the same infrastructure than the one taken from above (ad-hoc peer to peer wireless signal network) and is called Multi-Speakers Assistive Technology (MSAT). The wireless signal network may be based on WLAN or another wireless protocol.

The basic idea is to find the common features across all the individual signal (for each hearing device) by autocorrelation algorithm, to assign a attenuation weight and delay for each hearing aid and redistribute the clean signal like with an induction loop.

The processing unit, the method and the system described herein may help a person that is in a crowd and wants to improve the listening quality by increasing the SNR even when no telecoil is available.

If more than two hearing device users are connected to the described hearing assistance system and attend to the same event, then a user can use the signal from the other user to increase the contrast between the useful and the detrimental (noise and reverberation) signal. The benefit on sound quality increases when more users are joining the hearing assistance system. All the microphones of the hearing devices or hearing devices, respectively, form one single microphone array.

For instance, a user may wear a hearing assistance system compatible hearing aid using the specific app and joins a conference. The app will search all the app users attending to this event and they will establish a peer-to-peer connection. If the user is late and sits far away from the stage then she or he can increase the signal-to-noise-ratio by using the signal from someone sitting in the front of the audience. Everything is done automatically, no need to change program or check for an induction loop.

The invention claimed is:

1. A system comprising at least two binaural hearing systems and a system processing unit in communication with at least one of the at least two binaural hearing systems by said system signal processing unit comprising or being operatively connected to a wireless data communication interface for wirelessly communicating with at least one of said at least two binaural hearing systems, wherein each binaural hearing system comprises two spaced apart hearing devices, each hearing device comprising at least one input transducer for capturing incoming sound, the input transducers of the two spaced apart hearing devices together defining a reference axis when arranged at the head of a user, each of the at least two binaural hearing systems being configured to determine:

a binaural hearing system angle of incidence of incoming sound with respect to said reference axis and/or a binaural hearing system time delay between capturing of sound by the two input transducers of the two spaced apart hearing devices of the respective binaural hearing system, said system signal processing unit being configured to receive from said at least one binaural hearing system:

a first binaural hearing system electric audio signal and first binaural hearing system spatial information related to said first system electric audio signal originating from said first binaural hearing system, said first binaural hearing system spatial information comprising at least one of a first binaural hearing system angle of incidence of incoming sound and a first binaural hearing system time delay between capturing sound by the two spaced apart hearing devices of said first hearing aid system, and a second system electric audio signal and a second system spatial information related to said second system electric audio signal originating from said second binaural hearing system, said second system spatial information comprising at least one of a second system angle of incidence of incoming sound and a second system time delay between capturing sound by the two spaced apart hearing devices of said second hearing aid system, wherein said system signal processing unit is further configured generate an enhanced electric audio signal by processing said first and second system electric audio signals based on said first and second system spatial information.

2. The system according to claim 1, wherein the first binaural hearing system and the second binaural hearing system are both configured to discriminate at least two audio sources by assigning, based on the system time delay between capturing of sound and/or the system angle of incidence of incoming sound, incoming sound to one audio source of a group of sound sources comprising at least a first audio source and a second audio source.

3. The system according to claim 2, wherein said system signal processing unit is further configured to determine, for the first binaural hearing system, a first binaural hearing system first source distance between a first audio source and the first binaural hearing system, by using trigonometry, based on the first and second system spatial information and the first and second system time delay data, and to determine for the second binaural hearing system a second binaural hearing system first source distance between a first audio source and the second binaural hearing system by using trigonometry based on the first and second system spatial information and the first and second system time delay data.

4. The system according to claim 2, wherein said system signal processing unit is further configured to determine a target audio source among the at least two audio sources, by one of or a combination of the following:

determining the target audio source as being the source that is assigned to the strongest consistent system electric audio signal over time and/or determining the target audio source as being the source that is assigned to the system electric audio signal providing a minimum mean square error (MMSE) on the angles (i.e. the first and second angles) from the binaural hearing systems.

5. The system according to claim 4, wherein said system signal processing unit is configured to determine the strongest consistent system electric audio signal over time by calculating;

ArgMax (Sum{for each S(k)} Sum{for each received audio signal, R(t)}), where Sk is an audio source.

6. The system according to claim 4, wherein said system signal processing unit is configured to determine the system electric audio signal providing a minimum mean square error (MMSE) over the angles of incidence received from the binaural hearing systems by calculating: ArgMax sum (angle(i)^2).

7. The system according to claim 4, wherein said system signal processing unit is configured to generate the enhanced electric audio signal based on the system electric audio signal corresponding to the determined target audio source.

8. Hearing assistance system comprising a binaural hearing system according to claim 1, wherein the binaural hearing system comprises first and second hearing devices, each of the first and second hearing devices respectively comprises:

an input transducer configured to receive an acoustic sound signal and to convert said acoustic sound signal into a device electric input audio signal, an output transducer that is configured to convert a hearing device electric audio output signal into an audio output signal that a user can perceive as sound, and the input transducers of the two hearing devices of a respective binaural hearing aid system defining a reference axis.

9. Hearing assistance system according to claim 8, wherein each binaural hearing system comprises at least one wireless interface unit configured to communicate with the system signal processing unit and receiving generate an enhanced electric audio signal from the system signal processing unit, and at least one hearing aid signal processing unit being operatively connected to said input transducer, said output transducer and said wireless interface and being configured to process said device electric input audio signal and said enhanced electric audio signal (received from the system signal processing unit) to generate hearing device electric output audio signals for each output transducer.

10. Hearing assistance system according to claim 9, wherein the hearing aid signal processing unit is configured to process the device electric input audio signals from first and second hearing devices, and to determine a first angle of incidence between an audio source and the axis of reference defined by the respective binaural hearing system, wherein the angle of incidence is determined based on a time delay between the two device electric input audio signals at the first and the second hearing device of the binaural hearing system, to thus generate said spatial information.

11. Hearing assistance system according to claim 8, wherein the system signal processing unit is implemented in a server.

12. Method for generating an enhanced electric audio signal, said method comprising:

receiving a first system electric audio signal and first system spatial information ($\alpha_1$, $d_1$) related to said first system electric audio signal originating from said first binaural hearing system, said first system spatial information comprising at least one of a first system angle of incidence of incoming sound and a first system time delay between capturing sound by the two spaced apart hearing devices of said first hearing aid system, receiving a second system electric audio signal and second system spatial information related to said second system electric audio signal originating from said second binaural hearing system, said second system spatial information comprising at least one of a second system angle of incidence of incoming sound and a second system time delay between capturing sound by the two spaced apart hearing devices of said second hearing aid system, processing said first and second system electric audio signals based on said first and second system spatial information, and generating an enhanced electric audio signal from said first and second system electric audio signals.

13. Method according to claim 12, further comprising;

discriminating at least two audio sources by assigning, based on the time delay between capturing of sound and/or the angle of incidence of incoming sound, incoming sound to one audio source of a group of sound sources comprising at least a first audio source and a second audio source.

14. Method according to claim 12, further comprising;

determining for the first binaural hearing system a first system first source distance between a first audio source and the first binaural hearing system by using trigonometry based on the first and second system spatial information and the first and second system time delay data and determining for the second binaural hearing system a second system first source distance between a first audio source and the second binaural hearing system by using trigonometry based on the first and second system spatial information and the first and second system time delay data.

15. Data storage device containing data representing software code that when run on a personal mobile device performs the method according to claim 12.

* * * * *